United States Patent [19]

Walsh et al.

[11] Patent Number: 4,511,046

[45] Date of Patent: Apr. 16, 1985

[54] METHOD AND APPARATUS FOR DETECTING AN IRREGULAR PRODUCT IN A PRODUCT FLOW

[75] Inventors: Richard J. Walsh, Yuba City; Darrell D. Gyles, Sutter City, both of Calif.

[73] Assignee: Sunsweet Growers of California, Calif.

[21] Appl. No.: 472,428

[22] Filed: Mar. 7, 1983

[51] Int. Cl.[3] ..... B07C 5/09; B07C 5/34

[52] U.S. Cl. ..... 209/539; 209/557; 209/599; 209/699

[58] Field of Search ..... 209/539, 552, 559, 599, 209/600, 699, 688, 615, 616, 923, 557

[56] References Cited

U.S. PATENT DOCUMENTS

| | | | |
|---|---|---|---|
| 2,246,851 | 6/1941 | Jordan | 209/688 |
| 2,646,167 | 7/1953 | Bratun | 209/688 |
| 2,981,410 | 4/1961 | Perrelli | 209/600 |
| 3,282,314 | 11/1966 | Cantoni et al. | 209/602 |
| 4,009,650 | 3/1977 | Lascelles et al. | 209/559 |
| 4,146,136 | 3/1979 | Ross et al. | 209/599 |

*Primary Examiner*—Robert B. Reeves

*Assistant Examiner*—Donald T. Hajec

*Attorney, Agent, or Firm*—Townsend and Townsend

[57] ABSTRACT

Method and apparatus for detecting and intercepting an irregular product in a product flow are disclosed. The product flow is conveyed along a path from a first, product feed station past other product handling stations. Product flow is singulated and aligned at a guide station. The product then is delivered along a product flow axis and in a single file manner to an inspection station where the product, which may be processed, pitted fruit, is graded for firmness and where extraneous matter, such as fruit pits or portions of pits, is detected. Detection involves probing or otherwise impaling each individual product in the flow with a plurality of spaced, pin-like projections. An irregular product resists such probing and produces a pressure differential between the projections and the conveyor belt by which the irregular product is detected. After inspection, detected irregular products are discharged from the product flow. The resulting delivered product flow is of uniform grade and quality, and does not contain extraneous matter, such as fruit pits or portions of pits.

17 Claims, 3 Drawing Figures

METHOD AND APPARATUS FOR DETECTING AN IRREGULAR PRODUCT IN A PRODUCT FLOW

BACKGROUND OF THE INVENTION

1. Field of the Invention

The present invention relates to product inspection and grading. More particularly, the present invention relates to a method and apparatus for detecting and intercepting an irregular product in a product flow.

2. Description of the Prior Art

Most products are graded according to quality. Agricultural products, such as fruits, are no exception. Several factors influence the grade assigned to agricultural products. In the case of fruit, firmness is an indication of quality. If the fruit is very hard, it may not be ripe; if the fruit is very soft, it may be overripe or rotten.

Many fruits, especially drupaceous fruits, including prunes and apricots, and other fruits, such as dates, are processed before being brought to market. Such fruits are often pitted and/or dried. The grade of such processed fruits is influenced by the firmness of the fruit's flesh and by the presence of residual pit material.

In a batch of pitted fruit, there will always be some fruit in which a pit or a portion of the pit remains. The grade of the fruit is accordingly reduced if there is a significant amount of pit remaining with the fruit. Residual pit material in the pitted fruit also presents a safety hazard. A consumer of the product may not expect to encounter a pit. Biting into a pit unexpectedly may damage the consumer's teeth; unexpectedly swallowing a pit or piece of pit may cause more severe problems.

Inspecting fruit for ripeness and for residual materials, such as pits, is a labor intensive, imperfect process. To thoroughly hand inspect every piece of fruit in a product flow would require so much labor input as to raise the production price of processed, pitted fruit beyond its market value.

There has heretofore been no apparatus or method provided for inspecting fruit in a product flow on an individual basis wherein the inspection process does not, itself, degrade the quality of the fruit. U.S. Pat. No. 4,146,136 issued to Ross, et al., entitled, FOOD DETECTOR FOR FOOD PRODUCTS, is typical of the devices that have been available for pit detection. Such devices squeeze the food product through a narrow passage. Food products containing pits do not readily pass through the passage and are therefore detected. A disadvantage of a device of this type is that the fruit must be mauled to detect the pit. Such mauled fruit is of a lower grade and is therefore of less value in the market. Additionally, such devices are generally not useful in grading fruits according to ripeness.

SUMMARY OF THE INVENTION

The present invention provides a significant advance in the art of automatic fruit inspection and grading. A product flow may now be graded as to ripeness or may be inspected for extraneous matter, such as pits and pieces of pits. The present invention inspects and grades fruit in a product flow on a piece-by-piece basis. In this way, the quality of every piece of fruit in the product flow is assured.

The present invention detects and intercepts an irregular product in the product flow. A product is introduced to the present invention at a feed station. The product is then conveyed by a transport means, such as a conveyor flight, along a path from said feed station. Inspection of each product in the product flow is accomplished by aligning the product in a single file manner (singulation), along a common axis, using a guide means located at a second station along said product flow path.

The singulated product is directed along the product flow path to a third, product inspection station. At the third station a cylinder, which includes a plurality of radially extending, pin-like projections, is rotated about an axis, such that a cylinder outer surface moves about said axis along the product flow path. The pin-like projections are inserted into and impale each product as the singulated product flow moves along said path past said cylinder. If the product flesh is too hard or if the product contains a pit or piece of pit, the pin-like projections are resisted by the product such that they press the product downwardly into the conveyor flight. Such downward pressure downwardly deflects the conveyor flight from its horizontal path. A sensor operating in conjunction with the conveyor flight detects the downward deflection of the conveyor and produces appropriate signal information indicating an irregular product has been encountered. After a delay period which allows the detected irregular product to travel to a reject station, a reject device is actuated by said signal to remove the irregular product from the product flow. Acceptable products are readily impaled by said pin-like projections and no signal is produced for such products. After inspection, the acceptable products are "wiped" from said projections and proceed along said path. The present invention also may be operated in a reverse manner to reject overly ripe fruit. That is, a product that is readily impaled is rejected; a firm product is allowed to proceed. By providing several grading or inspection stations, a product may be directed along one of several paths, each path containing a product flow of a known grade.

Additional features of the invention include an overflow detector at the product alignment station, whereby excess product in the flow may be directed to other detector apparatus. Means are also provided for cleaning and sanitizing the pin-like projections to prevent a buildup of waste product matter or residue thereon, which might interfere with operation of the apparatus.

Products, such as fruit, inspected by the present invention are delivered in a continuous flow and have a known grade. The product processor can market such products with the assurance that they are of a consistent quality and that they are completely devoid of pits, pit portions, or other such undesirable waste matter. Additionally, products processed by the present invention are handled in a gentle manner, such that significant deformation of the product is prevented during product inspection and grading. In this way, the inspected product is of higher quality, less subject to deterioration resulting from excessive handling, and more aesthetically pleasing in appearance.

DETAILED DESCRIPTION OF A PREFERRED EMBODIMENT

Figure 1:
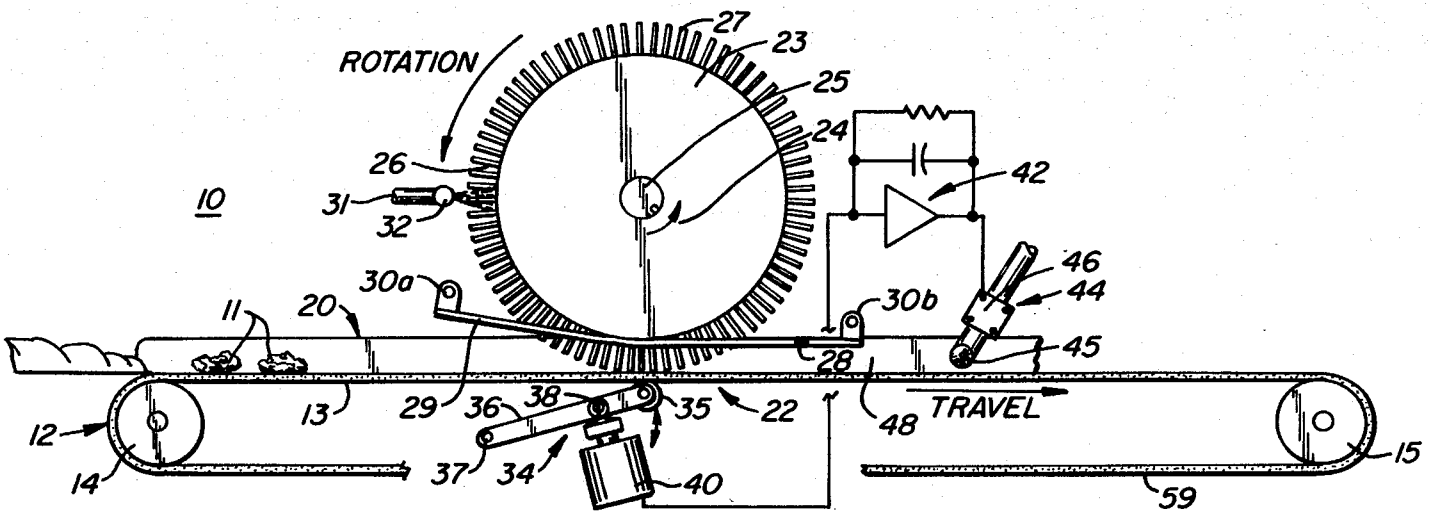
FIG. 1 is a schematic representation of the present invention.

The present invention provides a method and apparatus for detecting an irregular product in a product flow and is therefore useful in product grading and product inspection. FIG. 1 is a schematic representation of an exemplary embodiment of the present invention 10.

A product 11 is shown being transported by a conveyor 12 along a conveyor flight 13, which is a flexible conveyor belt. The product is conveyed in a direction of travel as indicated by the arrow. Conveyor operation is effected by conveyor drive wheels 14/15; motive force may be supplied by any known means (not shown), such as an electric, hydraulic, or pneumatic motor. Conveyor 12 includes a return flight 59.

Product 11, which may be an agricultural product including drupaceous fruits (such as prunes or apricots) or other fruits (such as dates), is fed onto conveyor flight 13 and transported by the conveyor flight past a guide station 20, wherein the product is arranged in a single file fashion and aligned along a product path axis.

The singulated, aligned product flow is next conveyed to an inspection station 22. A cylinder 23, located at inspection station 22, is rotated about an axis 24, such that the direction of cylinder rotation is the same as that of product flow along the product path. The axis of cylinder rotation is transverse to the product flow path or direction of travel. Cylinder 23 is rotated by a shaft 25; cylinder rotation is effected by any known motive means (not shown), such as an electric, hydraulic, or pneumatic motor.

Cylinder 23 includes an outer surface 26 about which radially extending, pin-like projections 27 are arranged at spaced locations. As the singulated product flow passes inspection station 22, each product is probed or impaled by pins 27. Rotation of cylinder 23 moves the impaled product to a wiper 28, comprising a screen 29 and a mounting assembly 30*a*/30*b*. Wiper 28 strips or wipes the impaled product from the projections, such that the product may be freely conveyed along conveyor flight 13 for delivery.

Conveyor flight 13 is flexible to the extent that it may be deflected downwardly from the product flow path when a preselected pressure differential is present between the conveyor flight and cylinder 23 at inspection station 22. A sensor 34 is located at inspection station 22 beneath conveyor flight 13 and includes a roller 35 coupled to a lever arm 36; the roller contacts the underside of conveyor flight 13 and rotates about its axis in accordance with movement of the conveyor flight. The lever arm may be freely pivoted about a pivot point 37 and includes an actuator 38 for operating a detector 40, which may be an electric switch, pressure sensor, etc. When a product is readily impaled by projections 27, there is no downward deflection of conveyor flight 13 and no actuation of detector 40. When a product is irregular, e.g. not ripe (too hard) or contains extraneous waste material (such as pits or portions of pits), the product is not readily impaled by the projections. Rather, they press downwardly on the product, creating a pressure differential between conveyor flight 13 and cylinder 23, which forces lever arm 36 to pivot about pivot point 37. In this way, actuator 38 is brought to bear upon detector 40, which is actuated, generating a signal indicative of a detected irregular product.

The signal generated thusly is coupled through a delay circuit 42 to a reject station 44. Delay circuit 42 provides a dead-time during which the detected irregular product is allowed to travel along conveyor flight 13 from inspection station 22 to reject station 44. The interval of delay introduced by delay device 42 is adjustable such that the reject device is actuated when the irregular product is present at reject port 45. In this way, inspection and rejection are synchronized to conveyor flight operation and inspection and reject station location, such that the proper (irregular) product is removed from the product flow. Because it may be desirable to operate the conveyor flight at various selected speeds, the delay interval may be controlled by the conveyor flight rate of operation.

All products, acceptable and irregular, are guided from inspection station 22 by guide wall 48. When an irregular product is guided past reject station 44, the product is removed from the product flow. A signal from delay device 42 is coupled to an actuator 46 and, accordingly, reject port 45 is operated. The reject port may provide a jet of pressurized fluid, such as air or water, from a solenoid value to remove the irregular product from the product flow, or it may provide a mechanical actuation, such as an extendable member, from an electric solenoid to remove the irregular product from the product flow. In this way, a continuous flow of inspected and graded product is provided, irregular products having been removed from the product flow. The rejected, irregular products may be collected at the reject station or they may be transferred to another conveyor flight for further inspection and grading.

Because some products, especially fruits, are sticky or oily, a waste residue may build up on the cylinder and on the pin-like projections. Such residue could present a health or contamination problem and/or may interfere with proper operation of the invention. A sanitizing spray 31 is provided as shown, which provides a cleaning liquid for rinsing such product residues from the invention. The spray may be continuous or intermittent; or it may provide an edible cleanser or may be plain water; several such sprays may be located at various points along the device; or said spray may be dispensed with in certain applications. Additionally, it may be desirable to apply a lubricant, preservative, or other coating to the product. The spray could provide such coating, if desired.

Figure 2:
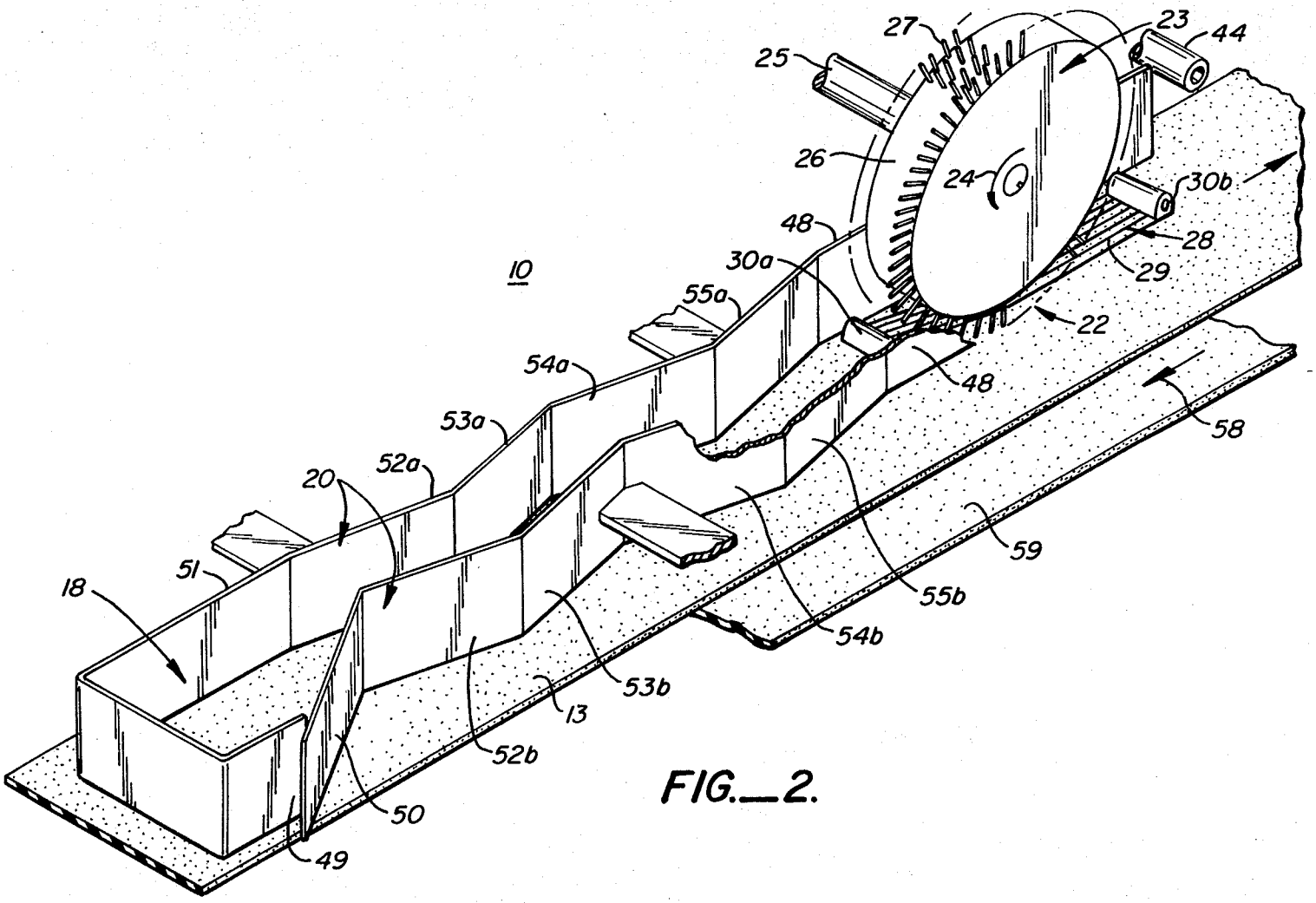
FIG. 2 is a perspective view of the present invention.

A perspective view of the exemplary embodiment of the present invention is shown in FIG. 2. A product is fed to the present invention at feed station 18. Walls 50/51 retain the product within the product path. The product is drawn through guide station 20 by flexible conveyor flight 13. Excess product presented at feed station 18 is directed away from the device through an overflow port 49. Such excess product as is directed away may be provided to additional apparatus, such as the present invention, for inspection and grading, or it may be recirculated and returned to feed station 18.

Guide station 20 provides a series of angled, parallel walls 52*a*/*b*, 53*a*/*b*, 54*a*/*b*, and 55*a*/*b*. As the product is drawn through the guide means along the conveyor flight, it is singulated and aligned along a product path axis. That is, the product is aligned in a single file fashion for presentation at inspection station 22 at right angles to cylinder axis 24.

Cylinder 23 is rotated in the same direction as the product flow about cylinder axis 24. Cylinder outer surface 26 includes a plurality of spaced, needle-like projections 27 which extend radially from cylinder 23.

As the product passes inspection station 22, the needle-like projections are inserted into the soft product flesh. Typically, the product is a drupaceous fruit, such as an apricot or a prune, or other fruits, such as dates. If the product is of acceptable quality, i.e. ripe or properly pitted, then the projections pierce the product and the product is moved to wiper assembly 28 where screen mesh 29 pulls the impaled fruit from the needle-like projections.

If, on the other hand, the product is irregular, i.e. not ripe or improperly pitted (containing pits or pit fragments), then the needle-like projections are unable to impale the product but rather, press downwardly upon the product, in turn, displacing conveyor flight 13 from its path as described above.

Irregular fruit is removed from the product flow path at reject station 44 and, thereafter, the graded, inspected product is delivered. The return conveyor flight 59 travels in the direction shown at 58, such that the invention operates in a continuous fashion.

Figure 3:
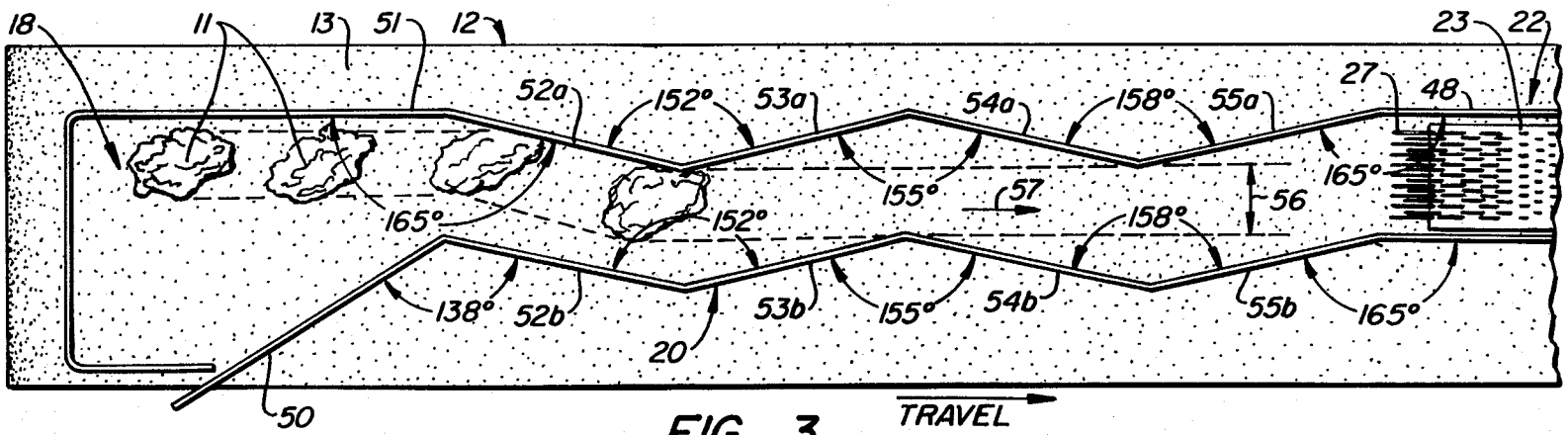
FIG. 3 is a schematic representation of a product guide station according to the present invention.

A detail of product guide (and aligning) station 20 is shown in FIG. 3. As the product is moved along a path 57 by conveyor flight 13, the product collides with the various walls of the guide station. A product colliding with wall 52*a*, for example, is pushed toward the center of path 57 by the wall. In addition to singulating the product, it is desirable to align the product with the product path axis, which is coincident with that of path 57. Accordingly, parallel walls 53*a/b*, 54*a/b*, and 55*a/b* are arranged with everincreasing angles (as shown), such that a product not properly oriented is pushed by the walls to an axially correct orientation. As a result, a singulated product flow is produced, with each product in the flow being aligned along an axis coincident with path 57 and within a path having an indicated width. Each product in the product flow is individually inspected and/or graded at inspection station 22 and, accordingly, singly accepted or rejected based upon the individual inspection. It should be noted that, although angular relations between the guides are expressed in FIG. 3, other effective orientations and angular relations are possible and may be desirable, depending on the shape of the product to be inspected and graded (e.g. round, long and narrow).

A product inspected and graded according to the present invention is subjected to a minimal amount of handling. That is, the product, when impaled, is slightly pricked by a series of pin-like projections, which projections probe the product for pits or pieces of pits that offer resistance to said projections. An unripe product is not impaled by the pin-like projections but, rather, also offers resistance thereto, such that the irregularity is readily detected. The amount of pressure differential produced by an irregular product necessary to produce an actuating product rejection is adjustable for different product grades and different types of products. For example, actuator 38 may be moved relative to pivot point 37 along lever arm 36, such that greater or lesser deflection of conveyor flight 13 produces actuation of detector 40. Additionally, the distance of detector 40 from actuator 38 may be increased or decreased, as desired.

In some embodiments of the invention, it may be desirable to reject overly ripe products (too soft). In such applications, each actuation of detector 40 indicates an acceptable product within the product flow. In the absence of such actuation an irregular product is sensed and, thereafter, rejected. Thus, a product that is readily impaled by the pin-like projections is removed from the product flow path, while products that are not readily impaled are allowed to continue in the product flow. Still other embodiments of the present invention contemplate a series of inspection stations, each of which is set to detect different levels of product firmness. Thus, a series of product flows may be produced in which each flow represents a different grade of product.

By inspecting a product for proper pitting, a potentially dangerous encounter by an unwary consumer with a pit or pit portion is eliminated. In this way, dental or internal injuries to the consumer are obviated. Products inspected by the present invention are safer, of more consistent and higher quality, and less likely to deteriorate due to excessive handling during the inspection and grading process. Additionally, the minimal amount of handling to which the product is subjected by the present invention provides a product that is more aesthetically appealing and that, therefore, has a higher market value. The present invention inspects each individual product in a product flow in an automatic manner such that costly labor is eliminated and the product is produced at a lower cost, which errors associated with labor intensive inspection and grading are eliminated.

The foregoing was given by way of illustration and example. Various other embodiments of the present invention are possible. For example, the product reject station may provide a blast of pressurized fluid such as air or water, or it may provide a mechanical actuation, such as by a solenoid. The product inspection station may include a sanitizing spray. The detection assembly may comprise a pneumatic, hydraulic, or electromechanical actuator, or it may comprise a weigh cell. The weigh cell would be coupled to a series of actuators to route an irregular product or products of varying grades from one product flow into one of several other selected product flows. By such means, automatic product grading is accomplished. Therefore, the scope of the invention should be limited only by the claims.

We claim:

1. Apparatus for detecting and intercepting an irregular product in a product flow, comprising:

means for conveying said product flow along a path;

means along said path for aligning said product flow in a single file manner;

a cylinder positioned along said path downstream of said aligning means, said cylinder being rotatable in the same direction as that of said product flow about an axis transverse to said path;

a plurality of elongate pin-like projections extending radially from said cylinder at spaced locations, said projections capable of impaling each acceptable product coming in contact therewith;

means for detecting a pressure increase on said conveying means caused by downward deflection thereof due to resistance of an irregular product to impaling by said pin-like projections, and for generating a signal upon detection of said pressure increase; and means for removing said irregular product from said product flow in response to said signal.

2. The apparatus of claim 1, said conveying means further comprising:

a continuous, flexible conveyor flight.

3. The apparatus of claim 1, further comprising:

means for wiping impaled products from said pin-like projections.

4. The apparatus of claim 1, said detecting means comprising:

an electrical switch operable at a selected pressure differential to generate said signal.

5. The apparatus of claim 1, said detecting means comprising:

a pressure sensor operable at a selected pressure differential to generate said signal.

6. The apparatus of claim 1, said removing means comprising:

a solenoid valve, operable in response to said signal, for providing a jet of pressurized fluid to remove said irregular product from said product flow.

7. The apparatus of claim 1, further comprising:

means for cleansing and sanitizing said pin-like projections.

8. Apparatus for detecting and intercepting an irregular product in a product flow, comprising:

a continuous, flexible conveyor flight for conveying said product flow along a path including a first, product feed station;

guide means, located at a second station along said path, for singulating and aligning said product flow;

a cylinder, located at a third station along said path, rotatable in a same direction as said product flow about an axis transverse to said path;

a plurality of pin-like projections extending radially from said cylinder at spaced locations about an outer cylinder surface, said projections readily impaling acceptable products within said product flow as said product flow is conveyed along said path past said third station;

means, located at said third station, for wiping each of said impaled products from said pin-like projections;

means, located at said third station, for cleansing and sanitizing said projections;

means, at said third station, for detecting a downward displacement of said conveyor created when an irregular product is pressed downwardly because said pin-like projections are unable to impale said product due to the product's irregularity, and for generating an actuating signal in accordance therewith; and reject means, located at a fourth station along said path, for intercepting a detected irregular product and for removing said irregular product from said product flow, in response to said actuating signal.

9. The apparatus of claim 8, said detecting means further comprising:

an electrical switch, operable at a selected downward conveyor deflection to generate said actuating signal for said reject means.

10. The apparatus of claim 8, said detecting means further comprising:

a pressure sensor, operable in response to said downward conveyor deflection, for generating said actuating signal for said reject means.

11. The apparatus of claims 9 or 10, said reject means further comprising:

a solenoid valve, operable in response to said actuating signal, for providing a jet of pressurized fluid at said fourth station to remove an irregular product from said product flow.

12. The apparatus of claim 8, further comprising:

delay means, coupled between said detecting means and said reject means, for witholding said reject means actuating signal produced by said detecting means until said detected irregular product is conveyed along said path to said fourth station.

13. The apparatus of claim 8, further comprising:

means, located along said path at said second station, responsive to a product overflow condition;

said responsive means directing a product overflow to additional detecting and intercepting apparatus.

14. A method for detecting and intercepting an irregular product in a product flow, comprising:

(a) conveying said product flow along a path;

(b) aligning said product flow in a single file manner along said path;

(c) passing said product flow under a rotating cylinder having a plurality of pin-like projections extending radially therefrom at spaced locations to impale penetrable products in said product flow, said cylinder being rotated about an axis transverse to said path in the same direction as said product flow;

(d) detecting a pressure differential generated by the downward deflection of a flexible conveyor flight due to resistance of an irregular product to impalement by said pin-like projections, and generating a signal in response to said pressure differential; and (e) removing said irregular product from said product flow in response to said signal.

15. The method of claim 14, further comprising:

wiping said impaled product from said projections.

16. The method of claim 20 wherein step (e) comprises directing a jet of pressurized fluid at said product flow to deflect therefrom said irregular product.

17. The method of claim 14, further comprising:

continuously cleansing and sanitizing said projections.

* * * * *